US010261430B2

(12) United States Patent
Chokan et al.

(10) Patent No.: US 10,261,430 B2
(45) Date of Patent: Apr. 16, 2019

(54) PHOTORECEPTOR FOR ELECTROPHOTOGRAPHY AND IMAGE FORMING APPARATUS EMPLOYING THE SAME

(71) Applicant: Samsung Electronics Co., Ltd., Suwon-si (KR)

(72) Inventors: Tomohito Chokan, Yokohama (JP); Keiichi Ishikawa, Yokohama (JP); Manabu Takezawa, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/403,421

(22) Filed: Jan. 11, 2017

(65) Prior Publication Data

US 2017/0205718 A1 Jul. 20, 2017

(30) Foreign Application Priority Data

Jan. 14, 2016 (JP) ..... 2016-005033
Oct. 27, 2016 (KR) ..... 10-2016-0141170

(51) Int. Cl.
*G03G 5/147* (2006.01)

(52) U.S. Cl.
CPC ..... *G03G 5/14704* (2013.01); *G03G 5/1473* (2013.01); *G03G 5/14726* (2013.01); *G03G 5/14734* (2013.01); *G03G 5/14747* (2013.01)

(58) Field of Classification Search
CPC ..... G03G 5/14704; G03G 5/14726; G03G 5/14734; G03G 5/14747
See application file for complete search history.

(56) References Cited

U.S. PATENT DOCUMENTS 5,008,172 A * 4/1991 Rokutanzono ..... G03G 5/14704 430/66
5,374,494 A 12/1994 Kashimura et al.
(Continued)

FOREIGN PATENT DOCUMENTS

JP 63-73267 A 4/1988
JP 6-258857 A 9/1994
(Continued)

OTHER PUBLICATIONS

"Silane Coupling Agents" Shin-Etsu Chemical Co., Ltd., 28 pages (Jun. 2017).*
(Continued)

*Primary Examiner* — Christopher D Rodee
(74) *Attorney, Agent, or Firm* — NSIP Law

(57) ABSTRACT

An electrophotographic photoreceptor includes a conductive support, a photosensitive layer on the conductive support, and a protective layer on the photosensitive layer. The protective layer includes a binder resin, metal oxide particles, and fluororesin particles. The metal oxide particles include, on a surface thereof, a first surface-treating agent including fluorine atoms, and a second surface-treating agent including a polymerizable reactive group and a hydrophobic group. At least some of the metal oxide particles are supported on a surface of the fluororesin particles. The fluororesin particles are fixed to the binder resin via the at least some of the metal oxide particles supported on the surface of the fluororesin particles.

23 Claims, 3 Drawing Sheets

(56) References Cited

U.S. PATENT DOCUMENTS 5,505,884 A * 4/1996 Burke ..... C08F 265/00 264/1.1
5,908,897 A * 6/1999 Nakamura ..... C08K 5/14 524/861
6,121,344 A * 9/2000 Angeletakis ..... A61K 6/0073 523/115
6,146,801 A * 11/2000 Ichikawa ..... G03G 9/10 430/111.35
6,183,926 B1 * 2/2001 Kuroda ..... G03G 9/0819 399/223
6,200,719 B1 * 3/2001 Kuroda ..... G03G 9/0819 399/252
6,492,081 B2 12/2002 Morikawa et al.
6,664,014 B1 * 12/2003 Kikuchi ..... G03G 5/14704 430/66
7,560,209 B2 7/2009 Tokutake et al.
8,557,486 B2 * 10/2013 Ishida ..... G03G 5/14704 430/66
9,746,818 B2 * 8/2017 Uchino ..... G03G 21/0094
2002/0119382 A1 * 8/2002 Nakata ..... G03G 5/14708 430/66
2004/0101774 A1 * 5/2004 Yoshimura ..... G03G 5/1476 430/66
2007/0019984 A1 * 1/2007 Inagaki ..... G03G 5/14726 430/66
2008/0199217 A1 8/2008 Iwamoto et al.
2008/0261135 A1 * 10/2008 Yamada ..... G03G 5/14704 430/58.1
2012/0031842 A1 * 2/2012 Freger ..... B01D 67/0093 210/650
2013/0109072 A1 * 5/2013 Tsunoda ..... C01B 37/00 435/176
2014/0072907 A1 * 3/2014 Sasaki ..... G03G 5/14704 430/56
2015/0099217 A1 * 4/2015 Hatano ..... G03G 5/14704 430/132
2015/0160573 A1 * 6/2015 Inagaki ..... G03G 5/14704 430/66
2015/0355562 A1 * 12/2015 Inagaki ..... G03G 5/147 430/58.1
2017/0075236 A1 * 3/2017 Kurachi ..... G03G 5/14704
2017/0168406 A1 * 6/2017 Sakimura ..... G03G 5/1476

FOREIGN PATENT DOCUMENTS

JP 11-95473 A 4/1999
JP 11-202531 A 7/1999
JP 3186010 B2 5/2001
JP 3262488 B2 12/2001
JP 2002-82466 A 3/2002
JP 2003-140373 A 5/2003
JP 2003-186232 A 7/2003
JP 2005-107490 A 4/2005
JP 2007-86734 A 4/2007
JP 2008-233893 A 10/2008
JP 2011027807 A * 2/2011
JP 2011-128546 A 6/2011
JP 2012-98591 A 5/2012
JP 2014-21133 A 2/2014
JP 2015-141269 A 8/2015

OTHER PUBLICATIONS

English language machine translation of JP-2011027807 (Feb. 2011).*

* cited by examiner

PHOTORECEPTOR FOR ELECTROPHOTOGRAPHY AND IMAGE FORMING APPARATUS EMPLOYING THE SAME

CROSS-REFERENCE TO RELATED APPLICATIONS

This application claims the benefit under 35 USC 119(a) of Japanese Patent Application No. 2016-005033 filed on Jan. 14, 2016, in the Japan Patent Office and Korean Patent Application No. 10-2016-0141170 filed on Oct. 27, 2016, in the Korean Intellectual Property Office, the entire disclosures of which are incorporated herein by reference for all purposes.

BACKGROUND

1. Field

This application relates to an electrophotographic photoreceptor and an image forming apparatus including the electrophotographic photoreceptor.

2. Description of Related Art

As electrophotographic photoreceptors, photoreceptors using inorganic materials such as amorphous silicon and organic photoreceptors using organic materials are known.

Organic photoreceptors have excellent optical properties in terms of a width of a light absorption wavelength band and an amount of absorption, and excellent electrical properties such as high sensitivity and stable charging characteristics. In addition, organic photoreceptors have wide material selectivity and may be easily manufactured at a low cost.

Because of these various advantages, organic photoreceptors have recently been widely used instead of inorganic photoreceptors in electrophotographic image forming apparatuses, such as photocopiers, facsimiles, laser printers, and multifunction copiers.

Toner, paper dust, and hydrophilic materials generated by a charging process adhere to a surface of an organic photoreceptor in an electrophotographic image forming apparatus. To remove the toner, paper dust, and hydrophilic materials, cleaning methods involving bringing a urethane-based rubber cleaning blade into contact with a surface of the photoreceptor have been generally used.

However, when a surface of the photoreceptor has a high frictional resistance, a squealing noise may be produced by the cleaning blade, or the cleaning blade may be turned over or inverted. When a blade squealing noise or blade turnover occurs, the blade is gradually damaged, causing toner to leak from the blade. The toner remaining on the surface of the photoreceptor may result in image defects due to poor cleaning performance. Therefore, it is important to suppress an increase of friction of a surface of the photoreceptor over time, to maintain cleaning performance of the surface of the photoreceptor, and to improve abrasion resistance or scratch resistance of the surface of the photoreceptor to facilitate stable acquisition of images for a long time.

In view of printing durability, a protective layer may be formed as a surface layer on a photoreceptor and a curable resin may be introduced into the protective layer to improve mechanical properties of the photoreceptor. For example, JP 3262488 discloses a protective layer including a curable resin and formed on a surface of the photoreceptor.

However, sufficient cleaning performance cannot be obtained merely by increasing mechanical strength. Also, it is difficult to obtain a photoreceptor having a suitable level of all of printing durability, cleaning performance, and scratch resistance.

Thus, attempts have been made to reduce the frictional resistance of the surface of the photoreceptor by improving a slidability thereof. For example, fluororesin particles, such as polytetrafluoroethylene (PTFE) particles, having an excellent lubricating ability may be added to a protective layer on the surface of the photoreceptor to reduce the frictional resistance of the surface. For example, JP 11-202531 discloses a protective layer containing colloidal silica, siloxane resin, conductive particles surface-treated with fluorine-containing compounds, and PTFE particles. JP 2007-86734 discloses a protective layer containing a charge transporting material, an abrasion-resistant resin, and PTFE particles.

JP 2003-140373 discloses a protective layer containing metal oxide particles such as titanium oxide and PTFE particles.

JP 2011-128546 discloses a protective layer containing organic-inorganic composite particles including a fluororesin such as PTFE and an inorganic material.

However, since PTFE molecules included in PTFE particles are not polar, a cohesive force among the PTFE particles becomes excessively large, resulting in extremely poor dispersibility of the PTFE particles in a dispersion liquid used in forming a protective layer. For this reason, a dispersant may be used to improve the dispersibility of PTFE particles in the protective layer. For example, JP 3186010 discloses a protective layer containing PTFE particles and a fluorine-based comb-like graft polymerization resin as a dispersant.

However, when a dispersant is used, a photoreceptor may have deteriorated electrical properties, an increased residual potential, occurrence of image flow, and a deteriorated printing durability, and thus satisfactory image characteristics may not be maintained. That is, when a dispersant having a high electrical resistance is used, a charge in the protective layer is trapped by the dispersant and does not flow adequately, resulting in an increase in a residual potential of the photoreceptor. When an increase in the residual potential of the photoreceptor cannot be suppressed, a sharply outlined electrostatic latent image may not be formed on a surface of the photoreceptor. In addition, in a dispersant having a hydrophilic group that may bind to fluorine atoms of PTFE particles, the hydrophilic group may cause moisture to adhere to a surface of the protective layer. Thus, charge may easily flow, resulting in occurrence of image flow and a low printing durability.

In addition, PTFE molecules included in PTFE particles have a stable molecular structure, and interaction between intermolecular forces is the only constraining force in the protective layer. For this reason, due to scratching by a blade against the surface of the protective layer, PTFE particles may detach from a surface of the protective layer. When PTFE particles detach from the surface of the protective layer, sliding properties (a slidability) of the protective layer may not be maintained, and an increase in the frictional resistance may not be suppressed, resulting in a deterioration of cleaning performance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an electrophotographic photoreceptor includes a conductive support, a photosensitive layer on the conductive support, and a protective layer on the photosensitive layer; the protective layer includes a binder resin, metal oxide particles, and fluororesin particles; the metal oxide particles include, on a surface thereof, a first surface-treating agent including fluorine atoms, and a second surface-treating agent including a polymerizable reactive group and a hydrophobic group; at least some of the metal oxide particles are supported on a surface of the fluororesin particles; and the fluororesin particles are fixed to the binder resin via the at least some of the metal oxide particles supported on the surface of the fluororesin particles.

A degree of a surface hydrophobicity of the metal oxide particles may be about 40% or greater.

The at least some of the metal oxide particles may be supported on the surface of the fluororesin particles by being adsorbed onto the surface of the fluororesin particles via the fluorine atoms of the first surface-treating agent.

The at least some of the metal oxide particles supported on the surface of the fluororesin particles may be bound to the binder resin via the polymerizable reactive group of the second surface-treating agent so that the fluororesin particles are fixed to the binder resin.

The first surface-treating agent may include an alkyl fluoride group having 4 to 7 carbon atoms.

The polymerizable reactive group of the second surface-treating agent may include at least one selected from the group consisting of an acryloyl group, a methacryloyl group, and a vinyl group.

The hydrophobic group of the second surface-treating agent may include at least one selected from the group consisting of an alkyl group including 6 or more carbon atoms and an alkylene group including 6 or more carbon atoms.

The metal oxide particles may include at least one selected from the group consisting of antimony-doped tin oxide, titanium oxide, and zinc oxide.

The fluororesin particles may include polytetrafluoroethylene (PTFE).

The binder resin may include a photocurable resin including a photofunctional group; and the photofunctional group may be bound to the polymerizable reactive group of the second surface-treating agent.

In another general aspect, a image forming apparatus includes an electrophotographic photoreceptor; a charging unit configured to charge the electrophotographic photoreceptor; a light exposure unit configured to expose the charged electrophotographic photoreceptor to light to form an electrostatic latent image on the charged electrophotographic photoreceptor; a developing unit configured to develop the electrostatic latent image using toner to form a toner image on the electrophotographic photoreceptor; a transferring unit configured to transfer the toner image to a transfer medium; and a cleaning unit configured to remove any toner remaining on the electrophotographic photoreceptor after the transferring of the toner image to the transfer medium; the electrophotographic photoreceptor includes a conductive support, a photosensitive layer on the conductive support, and a protective layer on the photosensitive layer; the protective layer includes a binder resin, metal oxide particles, and fluororesin particles; the metal oxide particles include, on a surface thereof, a first surface-treating agent including fluorine atoms, and a second surface-treating agent including a polymerizable reactive group and a hydrophobic group; at least some of the metal oxide particles are supported on a surface of the fluororesin particles; and the fluororesin particles are fixed to the binder resin via the at least some of the metal oxide particles supported on the surface of the fluororesin particles.

A degree of a surface hydrophobicity of the metal oxide particles may be about 40% or greater.

The at least some of the metal oxide particles may be supported on the surface of the fluororesin particles by being adsorbed onto the surface of the fluororesin particles via the fluorine atoms of the first surface-treating agent.

The at least some of the metal oxide particles supported on the surface of the fluororesin particles may be bound to the binder resin via the polymerizable reactive group of the second surface-treating agent so that the fluororesin particles are fixed to the binder resin.

The first surface-treating agent may include an alkyl fluoride group having 4 to 7 carbon atoms.

The polymerizable reactive group of the second surface-treating agent may include at least one selected from the group consisting of an acryloyl group, a methacryloyl group, and a vinyl group.

The hydrophobic group of the second surface-treating agent may include at least one selected from the group consisting of an alkyl group including 6 or more carbon atoms and an alkylene group including 6 or more carbon atoms.

The metal oxide particles may include at least one selected from the group consisting of antimony-doped tin oxide, titanium oxide, and zinc oxide.

The fluororesin particles may include PTFE.

The binder resin may include a photocurable resin including a photofunctional group; and the photofunctional group may be bound to the polymerizable reactive group of the second surface-treating agent.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application. Rather, the examples described herein have been provided merely to illustrate some of the many possible ways of implementing the methods, apparatuses, and/or systems described herein that will be apparent after an understanding of the disclosure of this application.

The expression "at least one of," when preceding a list of elements, modifies the entire list of elements and does not modify the individual elements of the list.

<Electrophotographic Photoreceptor>

Figure 1:
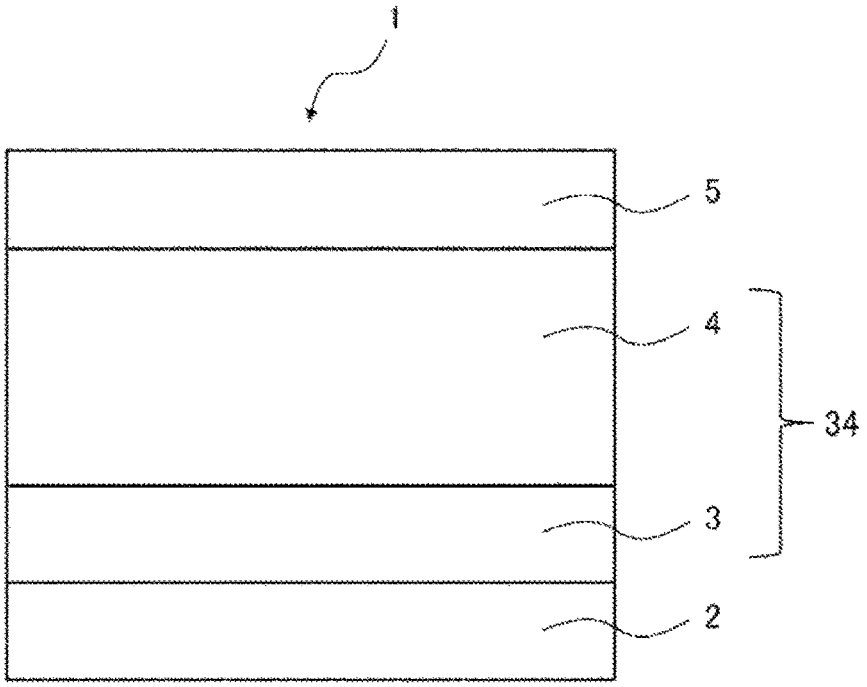
FIG. 1 is a schematic cross-sectional view illustrating an example of an electrophotographic photoreceptor.

FIG. 1 is a schematic cross-sectional view illustrating an example of an electrophotographic photoreceptor.

An electrophotographic photoreceptor 1 includes a conductive support 2, a photosensitive layer 34 on the conductive support 2, and a protective layer 5 on the photosensitive layer 34.

(Conductive Support)

The conductive support 2 may be any suitable conductive material. For example, the conductive support 2 may be obtained by molding a metal such as aluminum, copper, chromium, nickel, zinc, or stainless steel into a drum shape, a sheet shape, or a belt shape; by laminating a metal foil such as aluminum foil or copper foil on a plastic film; by depositing aluminum, indium oxide, or tin oxide on a plastic film; or by coating a conductive material alone or together with a binder resin on a metal film, a plastic film, or paper.

(Photosensitive Layer)

The photosensitive layer 34 may be selected from, for example, a negatively chargeable multi-layered photosensitive layer or a positively chargeable single-layered photosensitive layer prepared by using methods that are well known in the art.

FIG. 1 illustrates a negatively chargeable multi-layered photosensitive layer as the photosensitive layer 34 on the conductive support 2, wherein the photosensitive layer 34 includes a charge generating layer 3 and a charge transporting layer 4 on the charge generating layer 3.

(1) Negatively Chargeable Multi-Layered Photosensitive Layer

The negatively chargeable multi-layered photosensitive layer 34 includes the charge generating layer 3 and the charge transporting layer 4 laminated on the charge generating layer 3.

(1-1) Charge Generating Layer

The charge generating layer 3 is a layer including a charge generating material that generates charge as a main component and may further include a binder resin, if desired. Any suitable charge generating material may be used to form the charge generating layer 3. Examples of the charge generating material include monoazo pigments, disazo pigments, asymmetric disazo pigments, trisazo pigments, azo pigments having a carbazole skeleton, azo pigments having a distyryl benzene skeleton, azo pigments having a triphenylamine skeleton, azo pigments having a diphenylamine skeleton, perylene pigments, and phthalocyanine pigments. These charge generating materials may be used alone or in a combination of two or more thereof. Among these materials, the charge generating layer 3 may include at least one selected from the group consisting of oxotitanyl phthalocyanine and gallium phthalocyanine to obtain excellent electrical characteristics.

Examples of the binder resin used in the charge generating layer 3, if desired, include polyamides, polyurethanes, an epoxy resin, polyketones, polycarbonates, a silicon resin, an acrylic resin, polyvinyl butyrals, polyvinyl formals, and polyvinyl ketones. These binder resins may be used alone or in a combination of two or more thereof.

The charge generating material may be dispersed in a solvent together with the binder resin, if desired, by known dispersion methods using, for example, a ball mill, an attritor mill, a sand mill, a bead mill, or an ultrasonication process to obtain a coating liquid used to apply the charge generating layer 3 to the conductive support 2.

The charge generating layer 3 may have a thickness in a range of about 0.01 micrometers μm to about 5 μm, for example, about 0.05 μm to about 3 μm.

(1-2) Charge Transporting Layer

The charge transporting layer 4 has a charge transporting structure and includes a charge transporting material and a binder resin as main components.

The charge transporting layer 4 may include, as the charge transporting material, a hole transporting material, or an electron transporting material, if desired.

Examples of the hole transporting material include poly (N-vinylcarbazole) and derivatives thereof, poly(γ-carbazolylethylglutamate) and derivatives thereof, pyrene-formaldehyde condensates and derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, aminobiphenyl derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, distyrylbenzene derivatives, and enamine derivatives. These hole transporting materials may be used alone or in a combination of two or more thereof.

Examples of the binder resin include a thermoplastic or thermosetting resin such as a polystyrene resin, a styrene-acrylonitrile copolymer, a styrene-butadiene copolymer, a styrene-maleic anhydride copolymer, polyesters, polyvinyl chlorides, a vinyl chloride-vinyl acetate copolymer, polyvinyl acetates, a polycarbonate resin, and a polyarylate resin.

Examples of the electron transporting material include a benzoquinone-based, a cyanethylene-based, a cyanoquinodimethane-based, a fluorenone-based, a phenanthraquinone-based, a phthalic anhydride-based, a thiopyrane-based, a naphthalene-based, a diphenoquinone-based, and a stilbenequinone-based compound. The electron transporting material may be an electron receiving material such as chloranil, bromanil, tetracyanoethylene, tetracyanoquinodimethane, or 7-trinitro-9-fluorenone. These electron transporting materials may be used alone or in a combination of two or more thereof.

The charge transporting material and the binder resin may be dissolved in a solvent to obtain a coating liquid used to apply the charge transporting layer 4 to the charge generating layer 3.

The charge transporting layer 4 may have a thickness in a range of about 5 μm to about 40 μm, for example, about 10 μm to about 35 μm.

(2) Positively Chargeable Single-Layered Photosensitive Layer

Alternatively, the layer 34 shown in FIG. 1 may be a positively chargeable single-layered photosensitive layer 34 having a structure in which any one or any combination of any two or more of the charge generating material, the hole transporting material, and the electron transporting material are dispersed in a single layer including the binder resin. Each material may be used alone or in a combination of two or more thereof, as in the negatively chargeable multi-layered photosensitive layer.

The positively chargeable single-layered photosensitive layer 34 may be formed by preparing a coating liquid by dispersing or dissolving the aforementioned materials in a solvent including the binder resin in the same manner as in the negatively chargeable multi-layered photosensitive layer, applying the coating liquid to the conductive support 2, and solidifying the binder resin.

The positively chargeable single-layered photosensitive layer 34 may have a thickness in a range of about 5 to about 40 μm, for example, about 10 μm to about 35 μm.

(Protective Layer)

Figure 2:
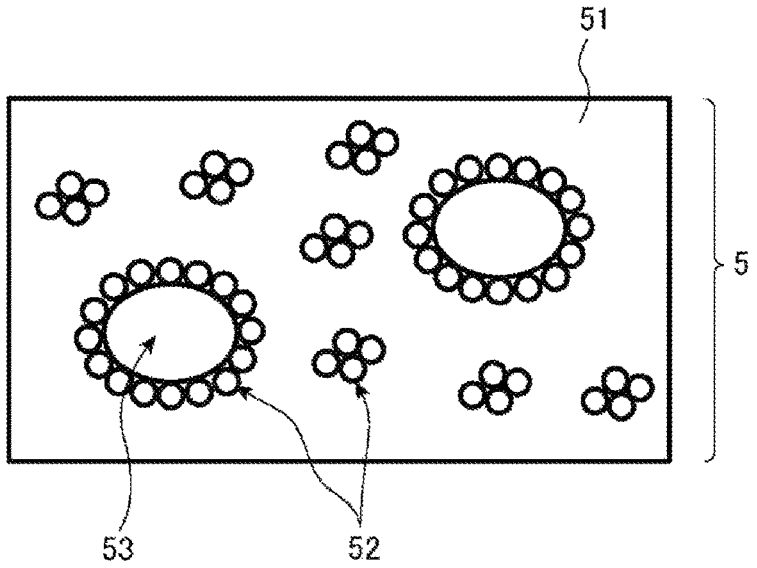
FIG. 2 is a schematic view illustrating an example of an internal structure of a protective layer of the electrophotographic photoreceptor shown in FIG. 1.
Figure 3:
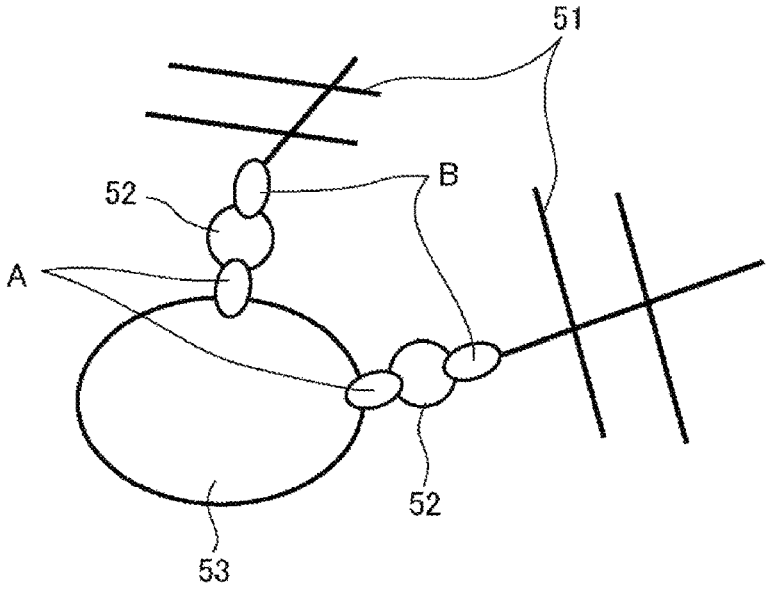
FIG. 3 is a schematic view illustrating an example of a fixing configuration of a fluororesin particle fixed to binder resins via metal oxide particles in the protective layer shown in FIGS. 1 and 2.

FIG. 2 is a schematic view illustrating an example of an internal structure of the protective 5 layer of the electrophotographic photoreceptor shown in FIG. 1, and FIG. 3 is a schematic view illustrating an example of a fixing configuration of a fluororesin particle fixed to binder resins via metal oxide particles in the protective layer 5 shown in FIGS. 1 and 2. The protective layer 5 includes a binder resin 51, metal oxide particles 52, and fluororesin particles 53.

Binder Resin

The binder resin 51 may be any suitable material forming a three-dimensional crosslinked structure to impart satisfactory mechanical properties, such as printing durability, to the protective layer. For example, the binder resin 51 may be a photocurable resin or a thermocurable resin. When a curable resin is used as the binder resin 51, due to its high crosslink density, long-term mechanical durability (improvement of abrasion resistance, scratch resistance, and surface abrasion resistance) of the protective layer 5 may be attained, and a high-definition electrophotographic image with high durability may be obtained. In addition, because the photocurable resin may harden in a shorter time than the thermocurable resin and is suitable for mass production, the photocurable resin may be used as the binder resin 51.

Hereinafter, an example in which a photocurable resin (hereinafter referred to as the photocurable resin 51) is used as the binder resin 51 will be described.

The photocurable resin 51 may be any suitable resin having a photofunctional group capable of binding to a polymerizable reactive group of a second surface-treating agent described later herein. Examples of the photocurable resin 51 include an acryl-based resin, an epoxy-based resin, and an oxetane-based resin. A photocurable copolymer resin may also be used.

Examples of the photofunctional group of the photocurable resin 51 include an acryl-based functional group, an epoxy group, and an oxetane group. For example, in consideration of the reactivity between a photofunctional group of the photocurable resin 51 and the polymerizable reactive group of the second surface-treating agent, when an acrylic group is used as the polymerizable reactive group of the second surface-treating agent, the photofunctional group of the photocurable resin 51 may be an acryl-based photofunctional group, and when an epoxy group is used as the polymerizable reactive group of the second surface-treating agent, the photofunctional group of the photocurable resin 51 may be an epoxy group. These combinations may facilitate crosslinking between the photofunctional group of the photocurable resin 51 and the polymerizable reactive group of the second surface-treating agent. Examples of the acryl-based photofunctional group include an acryloyl group ($CH_2CHCOO$—) and a methacryloyl group ($CH_2C(CH_3)COO$—).

Metal Oxide Particles

The metal oxide particles 52 have (a) a first surface-treating agent A including fluorine atoms and (b) a second surface-treating agent B including a polymerizable reactive group and a hydrophobic group, each of which is bound to a surface of the metal oxide particles 52.

The metal oxide particles 52 may include any suitable conductive metal oxide. For example, the metal oxide particles 52 may include at least one selected from the group consisting of an antimony-doped tin oxide, a phosphorus-doped tin oxide, a tin oxide, a titanium oxide, a zinc oxide, alumina, a zirconium oxide, an indium oxide, an antimony oxide, a bismuth oxide, a calcium oxide, and a tin-doped metal oxide to improve abrasion resistance.

Among these metal oxides, when an antimony-doped tin oxide, a titanium oxide, or a zinc oxide is used, electrical resistance of a protective layer may be controlled, thus leading to suppression of an increase in a residual potential of a surface of a photoreceptor (hereinafter also referred to as potential after exposure (VL)) and stabilization of charge transfer over time due to chemical stability of the metal oxide. Therefore, at least one selected from the group consisting of antimony-doped tin oxide, titanium oxide, and zinc oxide may be used as the metal oxide particles 52.

The metal oxide particles 52 may have an average primary particle diameter of about 5 nanometers (nm) to about 50 nm. The average primary particle diameter of the metal oxide particles 52 may be obtained, for example, by calculating an average value of a major axis and a minor axis of each of the metal oxide particles 52 from an image obtained by observation using a transmission electron microscope (TEM) and deriving an average value from the average values of 100 particles. However, when the particle diameter of the metal oxide particles 52 is greater than about 50 nm, dispersibility of the metal oxide particles 52 may deteriorate, resulting in deterioration of image quality.

When the particle diameter of the metal oxide particles 52 is less than about 5 nm, cohesiveness of the metal oxide particles 52 may be excessively high, resulting in lowering of abrasion resistance.

The metal oxide particles 52 may have an average primary particle diameter of about 8 nm to about 20 nm.

The metal oxide particles 52 after being dispersed by a disperse system may have an average particle diameter of about 30 nm to about 150 nm. The average particle diameter of the dispersed metal oxide particles 52 may be an average value of the particle diameters of all of the metal oxide particles 52 in the dispersed system in which non-agglomerated metal oxide particles 52 and agglomerated metal oxide particles 52 (i.e., agglomerates of the metal oxide particles 52) are mixed. The average particle diameter of such metal oxide particles 52 may be obtained, for example, by a dynamic light scattering method. In the dynamic light scattering method, agglomerates of the metal oxide particles 52 are regarded as one metal oxide particle 52.

However, when the average particle diameter of the metal oxide particles 52 is greater than 150 nm, the agglomerates of the metal oxide particles 52 may be segregated in a protective layer, and thus it may be difficult to homogeneously disperse the metal oxide particles 52.

In particular, the metal oxide particles 52 may have an average particle diameter of about 50 nm to about 120 nm.

A compounding ratio of the metal oxide particles 52 to the photocurable resin 51 may be about 10% by mass to about 60% by mass. When the compounding ratio is about 10% by mass to about 60% by mass, this compounding amount of the metal oxide particles 52 may be an amount required for binding to a surface of the fluororesin particles 53 dispersed in the photocurable resin 51. Thus, the protective layer 5 may have improved dispersibility and satisfactory conductivity.

However, when the compounding ratio is less than about 10% by mass, this compounding amount of the metal oxide particles 52 may be insufficient for improving dispersibility of the fluororesin particles 53. Thus, the fluororesin particles 53 may be exposed from a surface of the protective layer 5, and unevenness may be formed on the surface of the protective layer 5, causing the electrophotographic photoreceptor 1 to be useless.

When the compounding ratio is greater than about 60% by mass, this compounding amount of the metal oxide particles 52 may be excessive, which may result in an excessive amount of charge in the protective layer 5 and occurrence of image flow.

In particular, the compounding ratio of the metal oxide particles 52 to the photocurable resin 51 may be about 20% by mass to about 40% by mass.

First Surface-Treating Agent

The first surface-treating agent A may have fluorine atoms in a molecule thereof. The first surface-treating agent A having fluorine atoms may adsorb onto a surface of fluororesin particles 53 because of a high affinity of the fluorine atoms of the first surface-treating agent A with the fluorine atoms on the surface of fluororesin particles 53. Accordingly, some of the metal oxide particles 52 may be supported on the surface of the fluororesin particles 53 by the first surface-treating agent A bound to the surface of the fluororesin particles 53.

The first surface-treating agent A may have an alkyl fluoride group having 4 to 7 carbon atoms in a molecule of thereof. The first surface-treating agent A having the alkyl fluoride group having 4 to 7 carbon atoms may easily adsorb onto the fluororesin particles 53, and thus dispersibility of the fluororesin particles 53 in the protective layer 5 may improve, and the sliding properties (slidability) of a surface of the protective layer 5 may improve, resulting in improved cleaning performance. In addition, the first surface-treating agent A having the alkyl fluoride group having 4 to 7 carbon atoms may readily bind to a surface of the metal oxide particles 52, thereby increasing a degree of surface hydrophobicity of the metal oxide particles 52. Accordingly, an increase in an amount of water in the protective layer 5 may be suppressed, and hydrophobicity of the protective layer 5 may improve, consequently resulting in improved image characteristics. Thus, when the first surface-treating agent A having the alkyl fluoride group having 4 to 7 carbon atoms is used, the electrophotographic photoreceptor 1 may exhibit satisfactory performance.

The inventors have found that when the number of carbon atoms in the alkyl fluoride group of first surface-treating agent A is increased up to 7, a degree of surface hydrophobicity of the metal oxide particles 52 of which the surface is bound to the first surface-treating agent A also increases with the carbon number, whereas when the number of carbon atoms is 8 or greater, the degree of surface hydrophobicity suddenly decreases.

That is, when a main chain (carbon chain) is too long, i.e., when a carbon chain has 8 or greater carbon atoms, a degree of surface hydrophobicity of the metal oxide particles 52 may be reduced. This may result from a reduced amount of surface treatment of the metal oxide particles 52 due to steric hindrance of the first surface-treating agent A with an excessively long carbon chain. Otherwise, it may be construed that when the first surface-treating agent A is bound to a surface of the metal oxide particles 52, a degree of surface hydrophobicity of the metal oxide particles 52 increases due to the length of a carbon chain in the first surface-treating agent A; however, when a carbon chain of the first surface-treating agent A is excessively long, a degree of surface hydrophobicity of the metal oxide particles 52 may increase; thus, a surface of the hydrophobic metal oxide particles 52 may have low affinity with a hydrophilic solvent; consequently, the metal oxide particles 52 having increased surface hydrophobicity may agglomerate and thus readily sediment; for this reason, when a degree of surface hydrophobicity of the metal oxide particles 52 sedimented in an agglomerated state is measured by methanol titration, the measured value of the degree of surface hydrophobicity may be determined to be low. When a degree of surface hydrophobicity of the metal oxide particles 52 is low, an amount of water adsorbing to the protective layer 5 may increase, resulting in deterioration of image characteristics.

When a main chain (carbon chain) is too short, i.e., when a carbon chain has 3 or less carbon atoms, the metal oxide particles 52 may not be prevented from agglomeration. Thus, agglomerates of the metal oxide particles 52 may serve as a sterical hindrance, and dispersibility of the metal oxide particles 52 may deteriorate. Accordingly, electrical characteristics of the protective layer 5 may deteriorate.

In particular, the first surface-treating agent A having fluorine atoms may include an alkyl fluoride group having 4 to 6 carbon atoms.

The first surface-treating agent A having fluorine atoms may include an alkylene fluoride group in place of an alkyl fluoride group.

Any material that may bind to the metal oxide particles 52 and adsorb to the fluororesin particles 53 may be used as the first surface-treating agent A. For example, the first surface-treating agent A may be a silane coupling agent having fluorine atoms (hereinafter referred to as a fluorine-based silane coupling agent) or a phosphate ester-based surface-treating agent having fluorine atoms.

The fluorine-based silane coupling agent having fluorine atoms may bind to the metal oxide particles 52 by dehydration of an H group of the silane coupling site, such as that of a trimethoxy group, and an OH group on a surface of the metal oxide particles 52. In particular, the fluorine-based silane coupling agent may adsorb to the fluororesin particles 53 due to the affinity of the fluorine atoms of the fluorine-based silane coupling agent with fluorine atoms on a surface of the fluororesin particles 53. When a fluorine-based silane coupling agent is used as the first surface-treating agent A, the first surface-treating agent A may easily bind to a surface of metal oxide particles 52, the metal oxide particles 52 may be surface-treated simply, a degree of surface hydrophobicity of the metal oxide particles 52 may increase, and adsorption to the fluororesin particles 53 may easily occur.

Examples of the fluorine-based silane coupling agent include 1H,1H,2H,2H-nanofluorohexyl trimethoxy silane (which includes an alkyl fluoride group having 4 carbon atoms), and 1H,1H,2H,2H-perfluorooctyl trimethoxy silane (which includes an alkyl fluoride group having 6 carbon atoms).

The phosphate ester-based surface-treating agent having fluorine atoms may be bound to the metal oxide particles 52 by hydrogen bonding between a hydrogen atom in an OH group of the phosphate group and an oxygen atom in an OH group on a surface of the metal oxide particles 52. In addition, the phosphate ester-based surface-treating agent may adsorb to the fluororesin particles 53 due to the affinity of the fluorine atoms of the phosphate ester-based surface-treating agent with fluorine atoms on a surface of the fluororesin particles 53.

A compounding ratio of the first surface-treating agent A to the metal oxide particles 52 may be about 10% by mass to about 15% by mass. When the compounding ratio is about 10% by mass to about 15% by mass, this compounding amount of the first surface-treating agent A may be an amount required for binding to a surface of the metal oxide particles 52. Thus, dispersibility of the fluororesin particles 53 in the protective layer 5 may improve. Furthermore, since the first surface-treating agent A that has not been involved in surface treatment of the metal oxide particles 52 remains in a coating liquid in a small amount, the adverse effect of the remaining first surface-treating agent A on electrical properties of the protective layer 5 may be minimized.

However, when the compounding ratio is less than about 10% by mass, such a compounding amount of the first surface-treating agent A may be too small. Accordingly, an amount of the first surface-treating agent A binding to a surface of the metal oxide particles 52 may decrease, dispersibility of the fluororesin particles 53 in the protective layer 5 may not improve, and hydrophobicity of the protective layer 5 may deteriorate, thus resulting in occurrence of image flow.

When the compounding ratio is greater than about 15% by mass, such a compounding amount of the first surface-treating agent A may be excessive, and thus an amount of the first surface-treating agent A remaining in a coating liquid and not binding to a surface of the metal oxide particles 52 may be excessive. Accordingly, the remaining first surface-treating agent A may adversely affect electrical properties of the protective layer 5.

In particular, the compounding ratio of the first surface-treating agent A to the metal oxide particles 52 may be about 10% by mass to about 13.5% by mass.

Second Surface-Treating Agent

The second surface-treating agent B may include a polymerizable reactive group binding to a photofunctional group of the photocurable resin 51 and a hydrophobic group enhancing a degree of surface hydrophobicity of the metal oxide particles 52 in a molecule thereof.

In addition, the second surface-treating agent B may include the polymerizable reactive group and the hydrophobic group that are bound to each other, or that are apart from each other, in a molecule thereof. The meaning of the polymerizable reactive group being bound to the hydrophobic group may include a case in which some of the polymerizable reactive groups are bound to hydrophobic groups, and a case in which some of the hydrophobic groups are bound to polymerizable reactive groups.

Any suitable group capable of binding to a photofunctional group of the photocurable resin 51 may be used as a polymerizable reactive group of the second surface-treating agent B. Examples of the polymerizable reactive group include an acryloyl group ($CH_2CHCOO$), a methacryloyl group ($CH_2C(CH_3)COO$—), a vinyl group ($H_2C$═CH—), and an epoxy group. Among these polymerizable reactive groups, an acryloyl group, a methacryloyl group, and a vinyl group particularly may be more advantageous because they have excellent compatibility with the photocurable resin 51, and they have a double bond that is capable of enhancing the binding of the polymerizable reactive group to the photocurable resin 51. Accordingly, a molecule of the second surface-treating agent B may include at least one selected from the group consisting of an acryloyl group, a methacryloyl group, and a vinyl group.

Any suitable group enhancing a degree of surface hydrophobicity of the metal oxide particles 52 may be used as a hydrophobic group of the second surface-treating agent B. Examples of the hydrophobic group include an alkyl group, a methacryl group, an aliphatic vinyl group, an alkyl fluoride group, an alkylene group, and an alkylene fluoride group. Such hydrophobic groups including an alkyl group and the like may be more advantageous because they may have a longer carbon chain as compared with another hydrophobic group having the same number of carbon atoms, and they may have a length of the carbon chain that may be directly controlled by selecting the number of carbon atoms. Thus, when a hydrophobic group such as an alkyl group having a long carbon chain is used, metal oxide particles 52 may be prevented from agglomerating in the protective layer 5 and have improved dispersibility, consequently improving electrical properties of the protective layer 5. A molecule of the second surface-treating agent B may include at least one hydrophobic group that may enhance a degree of surface hydrophobicity of the metal oxide particles 52, and that may be selected from the group consisting of an alkyl group, an alkyl fluoride group, an alkylene group, and an alkylene fluoride group, each having the above stated ranges of the number of carbon atoms.

In particular, the hydrophobic group of the second surface-treating agent B may be an alkyl group or an alkylene group each having 6 or more carbon atoms. When an alkyl group or an alkylene group each having 6 or more carbon atoms is used, the second surface-treating agent B that is bound to a surface of the metal oxide particles 52 may improve dispersibility of the metal oxide particles 52, thus dispersing the metal oxide particles 52 in the protective layer 5 and consequently improving the hydrophobicity of the protective layer 5.

When the second surface-treating agent B includes an excessive number of carbon atoms in a polymerizable reactive group and a hydrophobic group thereof, surface treatment of the metal oxide particles 52 by the polymerizable reactive group or the hydrophobic group may not be effective due to steric hindrance. The upper limit of the number of carbon atoms of each of a polymerizable reactive group and a hydrophobic group in the second surface-treating agent B may be, for example, about 12.

In addition, the total number of carbon atoms of a polymerizable reactive group and a hydrophobic group in the second surface-treating agent B may be 2 to 12, for example, 2 to 8. When the total number of carbon atoms is greater than 12, due to steric hindrance resulting from the carbon chain having carbon atoms greater than 12, surface treatment of the metal oxide particles 52 may not be performed effectively.

Any suitable material that may bind to the photocurable resin 51 and the metal oxide particles 52 may be used as the second surface-treating agent B. Examples of the second surface-treating agent B include a polymerizable silane coupling agent and a phosphate ester-based surface-treating agent. The polymerizable silane coupling agent may bind to the metal oxide particles 52 by dehydration of an H group of the silane coupling site, such as that of a trimethoxy group, and an OH group on a surface of the metal oxide particles 52. In addition, the polymerizable silane coupling agent may be bound to the photocurable resin 51 via the binding of the polymerizable reactive group in the polymerizable silane coupling agent to a photofunctional group of the photocurable resin 51. When a polymerizable silane coupling agent is used as the second surface-treating agent B, the second surface-treating agent B may easily bind to a surface of metal oxide particles 52, the metal oxide particles 52 may be surface-treated simply, a degree of surface hydrophobicity of the metal oxide particles 52 may increase, and binding of the second surface-treating agent B to the photocurable resin 51 may be easily performed.

Examples of the polymerizable silane coupling agent include octenyl trimethoxysilane and methacryloxyoctyl trimethoxysilane.

The phosphate ester-based surface-treating agent may be bound to the metal oxide particles 52 by hydrogen bonding between a hydrogen atom in an OH group of the phosphate group and an oxygen atom in an OH group on a surface of the metal oxide particles 52. In addition, the phosphate ester-based surface-treating agent may be bound to the photocurable resin 51 via the binding of the polymerizable reactive group in the phosphate ester-based surface-treating agent to a photofunctional group of the photocurable resin 51.

A compounding ratio of the second surface-treating agent B to the metal oxide particles 52 may be about 3% by mass to about 10% by mass.

When the compounding ratio is about 3% by mass to about 10% by mass, such a compounding amount of the second surface-treating agent B may be an amount required for binding to a surface of the metal oxide particles 52. Accordingly, the surface hydrophobicity of the metal oxide particles 52 may improve, and the metal oxide particles 52 and the fluororesin particles 53 may be supported in the protective layer 5, thus improving electrical properties and cleaning performance of the protective layer 5.

However, when the compounding ratio is less than about 3% by mass, such a compounding amount of the second surface-treating agent B may be too small. Accordingly, an amount of the second surface-treating agent B binding to a surface of the metal oxide particles 52 may decrease, causing no increase in a degree of surface hydrophobicity of the metal oxide particles 52. Further, some of the metal oxide particles 52 may remain bound to the fluororesin particles 53 but unbound to the photocurable resin 51. Consequently, the metal oxide particles 52 and the fluororesin particles 53 may become separated from the protective layer 5. When an amount of the metal oxide particles 52 separated from the protective layer 5 increases, electrical properties of the protective layer 5 may not be maintained. When an amount of the fluororesin particles 53 separated from the protective layer 5 increases, the protective layer 5 may have deteriorated surface sliding properties (slidability), adversely affecting cleaning performance.

When the compounding ratio is greater than about 10% by mass, such a compounding amount of the second surface-treating agent B may be excessive, and thus an amount of the second surface-treating agent B remaining in a coating liquid and not involved in treatment of a surface of the metal oxide particles 52 may be excessive. Accordingly, the remaining second surface-treating agent B may adversely affect electrical properties of the protective layer 5.

In particular, the compounding ratio of the second surface-treating agent B to the metal oxide particles 52 may be about 3% by mass to about 5% by mass.

The total of the compounding ratio of the first surface-treating agent A to the metal oxide particles 52 (about 10% by mass to about 15% by mass) and the compounding ratio of the second surface-treating agent B to the metal oxide particles 52 (about 3% by mass to about 10% by mass) may be about 20% by mass or less. When the total of the compounding ratio of the first surface-treating agent A to the metal oxide particles 52 and the compounding ratio of the second surface-treating agent B to the metal oxide particles 52 is greater than about 20% by mass, such compounding amounts of the first surface-treating agent A and the second surface-treating agent B may be excessive. Thus, at least one of the first surface-treating agent A and the second surface-treating agent B may remain unreacted, and the at least one remaining surface-treating agent may adversely affect electrical properties of the protective layer 5.

In particular, the total of the compounding ratio of the first surface-treating agent A to the metal oxide particles 52 (about 10% by mass to about 13.5% by mass) and the compounding ratio of the second surface-treating agent B to the metal oxide particles 52 (about 3% by mass to about 5% by mass) may be about 15% by mass or less.

A degree of surface hydrophobicity of the metal oxide particles 52 of which a surface is bound to the first surface-treating agent A and the second surface-treating agent B may be about 40% or greater, for example, about 40% to about 60%. Such a high degree of surface hydrophobicity of the metal oxide particles 52 may be obtained, for example, by controlling the number of carbon atoms in an alkyl fluoride group of the first surface-treating agent A or the number of carbon atoms in a hydrophobic group of the second surface-treating agent B, each agent being bound to a surface of the metal oxide particles 52. When the metal oxide particles 52 having such a high degree of surface hydrophobicity is dispersed in the protective layer 5, due to the hydrophobicity generated by the first surface-treating agent A and the second surface-treating agent B, the protective layer 5 may not have an increased amount of moisture and may have a suitable amount of charge that may not cause image flow, and thus suitable electrical conductivity may be imparted to the protective layer 5.

However, when the surface hydrophobicity is less than about 40%, the protective layer 5 may have an increased amount of moisture and excessive charge, and thus unsuitable electrical conductivity may be imparted thereto. As a result, image flow may readily occur, which may deteriorate image characteristics. In addition, preparation of the metal oxide particles 52 having a degree of surface hydrophobicity greater than about 60% may not be easy to achieve.

Fluororesin Particles

Any suitable fluororesin that may reduce frictional resistance of a surface of the protective layer 5 and impart sliding properties (slidability) to the surface of the protective layer 5 may be used to form the fluororesin particles 53. Examples of the fluororesin include a tetrafluoroethylene resin, a trifluoro chloroethylene resin (a polychlorotrifluoroethylene resin), a hexafluoroethylene propylene resin, a fluorovinyl resin, a fluorovinylidene resin, a difluoro dichloroethylene resin, a perfluoroalkoxy alkane resin, and a tetrafluoroethylene-hexafluoropropylene copolymer. In particular, a tetrafluoroethylene resin (a polytetrafluoroethylene, hereinafter as referred to as "PTFE") is effective in improving hydrophobicity of the protective layer 5.

The fluororesin particles 53 may have an average particle diameter of about 0.2 μm to about 3 μm as measured by laser diffraction. When the fluororesin particles 53 having an average particle diameter of about 0.2 μm to about 3 μm are dispersed in the protective layer 5, the protective layer 5 may have improved hydrophobicity, and a surface of the protective layer 5 may have reduced frictional resistance, thus imparting satisfactory sliding properties (slidability) to the surface of the protective layer 5. However, when the average particle diameter of the fluororesin particles 53 is less than about 0.2 μm, such an average particle diameter is excessively small, and thus the fluororesin particles 53 may readily agglomerate and become segregated in the protective layer 5 due to deteriorated dispersibility. When the average particle diameter of the fluororesin particles 53 is greater than about 3 μm, such an average particle diameter is excessively large, and thus the fluororesin particles 53 may be exposed from a surface of the protective layer, and thus irregularities may be generated on the surface of the protective layer 5, causing the electrophotographic photoreceptor 1 to become useless.

In particular, the fluororesin particles 53 may have an average particle diameter of about 0.5 μm to about 3 μm.

A compounding ratio of the fluororesin particles 53 to the photocurable resin 51 may be about 10% by mass to about 40% by mass. When the compounding ratio is about 10% by mass to about 40% by mass, sliding properties (slidability) of the surface of the protective layer 5 may be improved.

However, when the compounding ratio is less than about 10% by mass, such a compounding amount of the fluororesin particles 53 may be excessively small as compared with that of the photocurable resin 51. Accordingly, sliding properties (slidability) of a surface of the protective layer 5 may not be maintained.

When the compounding ratio is greater than about 40% by mass, such a compounding amount of the fluororesin particles 53 may be excessively large, the fluororesin particles 53 may be exposed from a surface of the protective layer 5, and thus irregularities may be formed on the surface of the protective layer 5, causing the electrophotographic photoreceptor 1 to become useless.

In particular, the compounding ratio of the fluororesin particles 53 to the photocurable resin 51 may be about 20% by mass to about 40% by mass.

As shown in FIG. 2, in the protective layer 5, as described above, the photocurable resin 51 may form a three-dimensional crosslinked structure. In the protective layer 5, the metal oxide particles 52, a surface of which is bound to the first surface-treating agent A and the second surface-treating agent B, may be dispersed in the photocurable resin 51, with some of the metal oxide particles 52 being supported on the fluororesin particles 53 and some of the metal oxide particles 52 not being supported on the fluororesin particles 53. As shown in FIG. 3, the first surface-treating agent A may adsorb onto a surface of the fluororesin particles 53 via fluorine atoms of the first surface-treating agent A due to affinity of fluorine atoms on a surface of the fluororesin particles 53 with the fluorine atoms of the first surface-treating agent A, and thereby, the fluororesin particles 53 may support some of the metal oxide particles 52. The metal oxide particles 52 supported on the surface of the fluororesin particles 53 may be bound to the photocurable resin 51 via a polymerizable reactive group of the second surface-treating agent B by binding of the polymerizable reactive group of the second surface-treating agent B bound to a surface of the metal oxide particles 52 to a photofunctional group of the photocurable resin 51. Therefore, the fluororesin particles 53 may be fixed to the photocurable resin 51 via the metal oxide particles 52.

In addition, the metal oxide particles 52 in the protective layer 5, whether the metal oxide particles 52 are supported on a surface of the fluororesin particles 53 or not, may be dispersed in a non-agglomerated state. In a case in which only some of the metal oxide particles 52 are agglomerated, the metal oxide particles 52 may be adequately dispersed. However, a particle diameter of an agglomerate of the metal oxide particles 52 supported on a surface of the fluororesin particles 53 may generally be smaller than a particle diameter of an agglomerate of the metal oxide particles 52 not supported on a surface of the fluororesin particles 53.

In the protective layer 5 of the electrophotographic photoreceptor 1, dispersibility of the fluororesin particles 53 may be improved due to a surface of the fluororesin particles 53 supporting some of the metal oxide particles 52 of which a surface is bound to the first surface-treating agent A and the second surface-treating agent B. In addition, since the fluororesin particles 53 are fixed to the photocurable resin 51 via the metal oxide particles 52 bound to a surface of the fluororesin particles 53, the fluororesin particles 53 may not be separated from a surface of the protective layer 5, thus stably imparting satisfactory slidability to the surface of the protective layer 5. When a degree of surface hydrophobicity of the metal oxide particles 52, of which a surface is bound to the first surface-treating agent A and the second surface-treating agent B, is 40% or greater, the protective layer 5 may have a suitable amount of charge that may not cause image flow even without increasing an amount of moisture in the protective layer 5 in which the metal oxide particles 52 are dispersed. Accordingly, the protection layer 5 may have suitable conductivity.

The protective layer 5 may further include a charge transporting material. When the protective layer 5 includes a charge transporting material, a residual potential may be reduced, or deterioration of sensitivity may be suppressed. The charge transporting material used in the protective layer 5 may be any charge transporting material used in the charge transporting layer 4 described above.

The protective layer 5 may have a thickness in a range of about 0.1 μm to about 10 μm, for example, about 1 μm to about 7 μm.

The protective layer 5 may be obtained by curing a coating liquid for forming the protective layer 5. The photocurable resin 51 in the coating liquid of the protective layer 5 may be cured by irradiating active rays to cause radical polymerization and thereby forming a crosslinking bond between molecules. Examples of the active rays include electron rays and ultraviolet rays. In consideration of mass productivity, ultraviolet rays may be used as the active rays. A metal halide lamp, a mercury lamp, or an ultraviolet light-emitting device (LED) may be used as an irradiator.

(Intermediate Layer)

An intermediate layer (not show in FIG. 1) may further be disposed between the conductive support 2 and the charge generating layer 3. The intermediate layer may function as a barrier layer for controlling charge injection at an interface, or as an adhesive layer. The intermediate layer may mainly include a binder resin, but may also include a metal or an alloy, or their oxides, their salts, or a surfactant. Examples of the binder resin included in the intermediate layer include polyesters, polyurethanes, polyarylates, polyethylenes, polystyrenes, polybutadienes, polycarbonates, polyamides, polypropylenes, polyimides, a phenol resin, an acryl resin, a silicon resin, an epoxy resin, a urea resin, an aryl resin, an alkyd resin, polyamideimides, polysulfones, polyaryl ethers, polyacetals, and a butyral resin.

The intermediate layer may have a thickness in a range of about 0.05 μm to about 7 μm, for example, about 0.1 μm to about 2 μm.

Coating liquids for forming each of the charge generating layer 3, the charge transporting layer 4, and the protective layer 5, and, if needed, the intermediate layer, may be prepared and coated on the conductive support 2 by a known coating method. Examples of the coating method include a blade coating method, a dip coating method, a ring coating method, and a spray coating method. In addition, when the protective layer 5 or other layer is formed on the conductive support 2 by the ring coating method, a relatively small amount of a coating liquid may be required.

A method of preparing a coating liquid of the protective layer 5 will be described hereinafter.

First, the metal oxide particles 52, the first surface-treating agent A, and the second surface-treating agent B are mixed together in a dispersion solvent and dispersed by using a disperser, e.g., a bead mill, to prepare a dispersion liquid. In the preparing of the dispersion liquid, the first surface-treating agent A and the second surface-treating agent B are bound to a surface of the metal oxide particles 52. A degree of surface hydrophobicity of the metal oxide particles 52 may be determined by adjusting a dispersion time and compounding ratios of the first surface-treating agent A and the second surface-treating agent B to the metal oxide particles 52 when preparing the dispersion liquid.

Next, the prepared dispersion liquid is mixed with the photocurable resin 51 and the fluororesin particles 53, and the resulting mixture is dispersed by a known method such as ultrasonic irradiation to prepare a coating liquid for forming the protective layer 5.

In the examples described above, a photocurable resin was used as the binder resin 51, but a thermocurable resin may also be used as the binder resin 51.

The thermocurable resin may be any suitable resin having a functional group capable of binding to a polymerizable reactive group of the second surface-treating agent B. Examples of the thermocurable resin include an acryl-based resin, an alkyd resin, an amino resin, and a melamine resin.

In the examples of the electrophotographic photoreceptor 1 described above, the metal oxide particles 52, of which a surface is bound to the first surface-treating agent A and the second surface-treating agent B dispersed in the photocurable resin 51 of the protective layer 5, prevent agglomeration of the fluororesin particles 53 of which a surface supports some of the metal oxide particles 52. In addition, separation of the fluororesin particles 53 from the protective layer 5 and an increase in a residual potential of a surface of the protective layer 5 are suppressed. In addition, since some of the metal oxide particles 52 of which a surface is bound to the first surface-treating agent A and the second surface-treating agent B are homogeneously dispersed in the protective layer 5, regardless of whether they are supported on a surface of the fluororesin particles 53 or not, satisfactory electrical properties of the protective layer 5 are maintained stably over a long time. Therefore, in the examples described above, an electrophotographic photoreceptor may be obtained that maintains both satisfactory cleaning performance and image characteristics stably over a long time while having excellent durability and a long lifespan.

<Electrophotographic Image Forming Apparatus>

An example of an electrophotographic image forming apparatus may include any of the examples of an electrophotographic photoreceptor described above, a charging unit that that charges an outer surface of the electrophotographic photoreceptor, a light exposure unit, a developing unit, and a cleaning unit. Hereinafter, this will be described with reference to FIG. 4.

Figure 4:
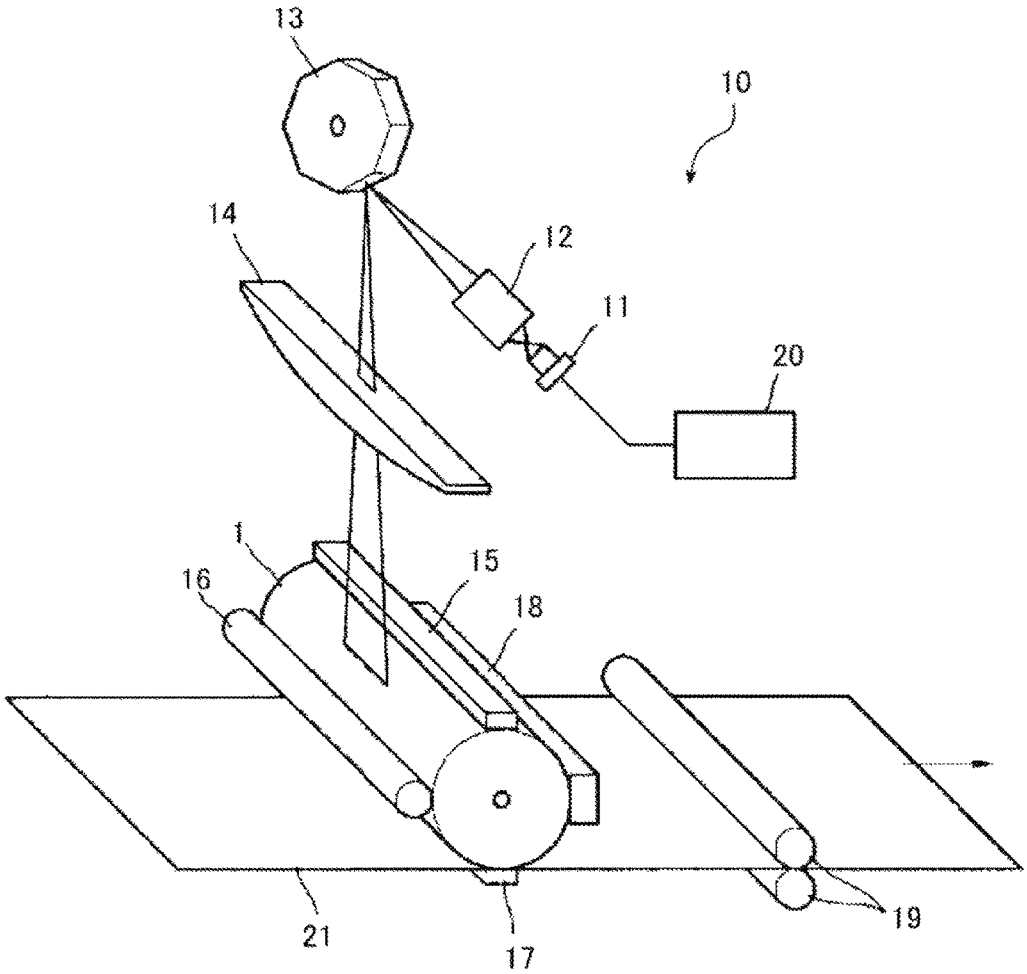
FIG. 4 is a schematic view illustrating an example of an electrophotographic image forming apparatus.

FIG. 4 is a schematic view illustrating an example of an electrophotographic image forming apparatus. An electrophotographic image forming apparatus 10 includes a semiconductor laser 11 as the light exposure unit. A projected laser beam is modulated by a control circuit 20 in accordance with image information, parallelized by a correction optical system 12, and reflected by a rotating polygon mirror 13 to perform a scanning motion. The laser beam is focused on a surface of the electrophotographic photoreceptor 1 using an f-θ lens 14 to expose the electrophotographic photoreceptor 1 in accordance with the image information. The electrophotographic photoreceptor 1 is charged in advance by a charging device 15, an electrostatic latent image is formed on the electrophotographic photoreceptor 1 by this exposure. Then, the electrostatic latent image formed on the electrophotographic photoreceptor 1 is developed by a developing device 16 using toner to form a toner image on the electrophotographic receptor, thereby visualizing an image. The toner image is transferred to an image receptor 21, i.e., a transfer medium such as paper, by a transfer device 17 and fixed by a fixing device 19 to obtain a printed image. A cleaning device 18 removes any toner or toner components remaining on the surface of the electrophotographic photoreceptor 1 after the transferring of the toner image to image receptor 21, thus enabling the electrophotographic photoreceptor 1 to be used repeatedly.

As illustrated in FIG. 4, the electrophotographic photoreceptor 1 having a drum shape rotates about a shaft at a predetermined peripheral speed. An outer surface of the electrophotographic photoreceptor 1 is uniformly charged by the charging unit 15 with a positive or negative predetermined uniform charge while rotating. For example, an oscillating voltage obtained by superimposing an alternating current (AC) voltage on an direct current (DC) voltage may be applied thereto. Although the electrophotographic photoreceptor 1 having a drum shape is described herein, an electrophotographic photoreceptor having a sheet or belt shape may also be used.

The charging device 15 may be a contact type charging device that supplies charge by bringing a charging member such as a charging roller or a charging brush into contact with the electrophotographic photoreceptor 1. In addition to the charging device 15 illustrated in FIG. 4, a non-contact type charging roller or a scorotron charging device or corotron charging device using corona discharge may also be used as the charging unit.

Furthermore, a plurality of components among the electrophotographic photoreceptor 1, the charging unit 15, and the developing unit 19 of the electrophotographic image forming apparatus 10 may be integrated into a process cartridge, and the process cartridge may be detachably coupled to a main body of the electrophotographic image forming apparatus 10 such as a photocopier or a laser beam printer.

As described above, the electrophotographic image forming apparatus 10 according to an example includes the electrophotographic photoreceptor 1 maintaining satisfactory cleaning performance and image characteristics stably over a long time and having excellent durability and a long lifespan. Thus, although a surface of the electrophotographic photoreceptor 1 is slowly worn down when in use, sliding properties (slidability) of the surface may be maintained. Accordingly, the electrophotographic photoreceptor 1 may have satisfactory cleaning performance and image characteristics over a long time. Therefore, a cleaning unit may not be easily damaged, allowing the cleaning unit as well as the electrophotographic photoreceptor 1 to be used for a long time. Thus, the electrophotographic image forming apparatus 10 may have a long lifespan.

EXAMPLES

Hereinafter, several examples and comparative examples will be described in detail.

Example 1

A photoreceptor was prepared in the following order.

(Conductive Support)

An aluminum tube having an external diameter of 30 mm was used as a conductive support.

(Intermediate Layer)

Materials listed below were dispersed using a bead mill for 5 hours. CM8000 (available from Toray Industries, Inc.) was used as a polyamide resin, and MT-500SA (available from Tayca Corporation) was used as titanium oxide.

Polyamide resin: 5 parts by mass

Titanium oxide: 5 parts by mass

Methanol: 50 parts by mass n-propanol: 10 parts by mass

The thus prepared dispersion was coated on the conductive support by dip coating to form an intermediate layer having a thickness of 1 μm.

(Charge Generating Layer)

Materials listed below were dispersed using a bead mill for 3 hours. BX-5 (available from Sekisui Chemical Co., Ltd.) was used as a butyral resin.

Oxotitanyl phthalocyanine pigment (Y type): 10 parts by mass

Butyral resin: 10 parts by mass 1,2-dimethoxyethane: 900 parts by mass

Cyclohexanone: 100 parts by mass

The thus prepared dispersion was coated on the conductive support, on which the intermediate layer had been formed as described above, by dip coating to form a charge generating layer having a thickness of 0.2 μm.

(Charge Transporting Layer)

Materials listed below were mixed with and dissolved in 100 parts by mass of tetrahydrofurane (THF), 1,1-bis(4-diethylaminophenyl)-4,4-diphenyl-1,3-butadiene was used as a charge transporting material, and PCZ-500 (available from Mitsubishi Gas Chemical Company, Inc.) was used as a polycarbonate.

Charge transporting material: 10 parts by mass

Binder resin: polycarbonate 10 parts by mass

Antioxidant: dibutylhydroxy toluene (BHT) 0.1 parts by mass

The thus prepared solution was coated on the conductive support, on which the charge generating layer had been formed as described above, by dip coating to form a charge transporting layer having a thickness of 20 μm. Then, the resulting structure was dried at 135° C. for 30 minutes.

(Protective Layer)

As in the following, first, a metal oxide particles dispersion liquid was prepared and then used to prepare a protective layer coating liquid, which was then used to prepare a protective layer.

The metal oxide particles dispersion liquid included metal oxide particles, the first surface-treating agent A, the second surface-treating agent B, and a dispersion solvent. The protective layer coating liquid included the metal oxide particles dispersion liquid, a photocurable resin, fluororesin particles, a polymerization initiator, and a dispersion solvent.

<Preparation of Metal Oxide Particles Dispersion Liquid>

Antimony-doped tin oxide (hereinafter referred to as "ATO") particles (an average primary particle diameter in a range of 10 nm to 15 nm, product name T-1, available from Mitsubishi Materials Electronic Chemicals Co., Ltd.) were used as metal oxide particles. 1H,1H,2H,2H-nanofluorohexyl trimethoxysilane (product name T2918, available from Tokyo Chemical Industry Co., Ltd.), which is a fluorine-based silane coupling agent, was used as the first surface-treating agent A. Octenyl trimethoxysilane (product name KBM1083, available from Shin-Etsu Silicone Co., Ltd.), which is a polymerizable silane coupling agent, was used as the second surface-treating agent B. A compounding ratio of the first surface-treating agent A to the ATO particles was 10% by mass, and a compounding ratio of the second surface-treating agent B to the ATO particles was 4% by mass. Isopropyl alcohol (IPA, guaranteed reagent 99.5%, available from Kishida Chemical Co., Ltd.) was used as a dispersion solvent. These materials were mixed at the following compounding ratios and dispersed using a bead mill to prepare an ATO particles dispersion liquid. The dispersion was performed for 90 hours.

Metal oxide particles: ATO particles 50 parts by mass

First surface-treating agent A: Fluorine-based silane coupling agent 5 parts by mass Second surface-treating agent B: Polymerizable silane coupling agent 2 parts by mass Dispersion solvent: 200 parts by mass The average particle diameter (D50) of the ATO particles of the thus prepared ATO particles dispersion liquid was measured by a dynamic light scattering method using a particle size analyzer (product name ELSZ-2, available from Otsuka Electronics Co., Ltd.) with an integration number of 70 times. D50 of the ATO particles was 65 nm. Further, a degree of surface hydrophobicity of the ATO particles in the ATO particles dispersion liquid was measured by methanol titration as in the following description. The degree of surface hydrophobicity of the ATO particles was 46%. The measurement results are shown in Table 1 below.

<Measurement of Degree of Hydrophobicity by Methanol Titration>

To a 2-liter glass beaker having an inner diameter of 7 cm and containing 100 ml of ion-exchanged water, 0.2 g of particles for measuring a degree of hydrophobicity were added thereto, and then stirred by a magnetic stirrer. Methanol was filled into the tip of a buret, and the tip of the buret was immerged into the solution in the beaker. Then, 20 mL of methanol was released into the solution in the glass beaker while stirring the solution. Stirring was stopped after 30 seconds, and a state of the solution was observed 1 minute after stirring was stopped. This process was repeated. A value obtained by the following formula was determined as a degree of hydrophobicity, in which the total amount of methanol which had been added until silica particles did not float at the surface of the solution 1 minute after stirring was stopped, is represented by Y (mL). The temperature of water in the beaker was adjusted to 20° C.±1° C. to carry out the measurement.

$$\text{Degree of hydrophobicity}=[Y/(100+Y)]\times 100\%]$$

<Preparation of Protective Layer Coating Liquid>

2-methyl-1-(4-methylthiophenyl)-2-morpholinopropane-1-one (product name Irgacure 907, available from BASF Japan Co., Ltd.) was used as a polymerization initiator. A polyfunctional fluorine-modified acrylic resin (trade name ACU-3, available from Kanto Denka Kogyo Co., Ltd.) was used as a photocurable resin. IPA (guaranteed reagent 99.5%, available from Kishida Chemical Co., Ltd.) was used as a dispersion solvent. Polytetrafluoroethylene (PTFE) particles (an average particle diameter of 2.3 μm, a maximum particle diameter of 4.62 μm, product name KTL1N, available from Kitamura Co., Ltd.) were used as fluororesin particles. A compounding ratio of the PTFE particles to the photocurable resin was 30% by mass. These materials were added to the ATO particles dispersion liquid at the following compounding ratios and mixed and stirred under light shielding. Then, the mixture was irradiated with ultrasonic waves from an ultrasonic oscillator for 5 minutes (oscillation frequency of 40 kilohertz (kHz), ultrasonic output of 50 watts (W)). During the ultrasonic irradiation, components in the mixture were dispersed in a dispersion solvent to prepare a protective layer coating liquid.

Polymerization initiator: 10 parts by mass
Photocurable resin: 100 parts by mass
Fluororesin particles: PTFE particles 30 parts by mass
Dispersion solvent: IPA 150 parts by mass
ATO particles dispersion liquid: 100 parts by mass
<Formation of Protective Layer>

After forming the charge transporting layer as described above, the protective layer coating liquid was coated on a dry conductive support by a ring coating method. After the coating, the solvent was dried at a temperature of 80° C. for 10 minutes. After the drying, the photocurable resin in the dry coating film on the conductive support thus prepared was cured by irradiating the dry coating film with ultraviolet rays at an ultraviolet exposure dose of 3000 millijoules per square centimeter (mJ/cm$^2$) from a metal halide lamp (product name M08-L41C, available from Iwasaki Electric Co., Ltd.), and a protective layer having a thickness of 3 μm was formed, thereby completing the manufacture of an organic photoreceptor. The ultraviolet exposure dose of 3000 mJ/cm$^2$ was obtained by rotating the conductive support at a distance apart from the metal halide lamp in a range of 15 cm to 20 cm, adjusting an irradiation intensity in a range of 250 watts per square centimeter (W/cm$^2$) to 300 W/cm$^2$, and irradiating for a time in a range of 120 seconds to 180 seconds.

Example 2

An organic photoreceptor was manufactured in the same manner as in Example 1, except that 30 parts by mass of different PTFE particles (an average particle diameter of 2.59 μm, a maximum particle diameter of 7.78 μm, product name KTL2N, available from Kitamura Co., Ltd.) was used instead of KTL1N which was added to the protective layer coating liquid as the PTFE particles in Example 1.

D50 and a degree of surface hydrophobicity of the ATO particles in the ATO particles dispersion liquid prepared in the preparation of the protective layer of the photoreceptor were measured in the same manner as in Example 1. D50 of the ATO particles was 73 nm and a degree of surface hydrophobicity thereof was 47%. The results of measurement are shown in Table 1 below.

Example 3

An organic photoreceptor was manufactured in the same manner as in Example 1, except that 2 parts by mass of a different fluorine-based silane coupling agent, 1H,1H,2H,2H-perfluorooctyl trimethoxy silane (product name NQ-H03, available from Qufu Wanda Chemical Co., Ltd), was used instead of T2918 as the first surface-treating agent A (i.e., a fluorine-based silane coupling agent) added to the ATO particles dispersion liquid in Example 1.

D50 and a degree of surface hydrophobicity of the ATO particles in the ATO particles dispersion liquid were measured in the same manner as in Example 1. D50 of the ATO particles was 95 nm and a degree of surface hydrophobicity thereof was 43%. The results of measurement are shown in Table 1 below.

Comparative Example 1

An organic photoreceptor was manufactured in the same manner as in Example 1, except that 2 parts by mass of a different polymerizable silane coupling agent, methacryloxyoctyl trimethoxysilane (product name KBM5803, available from Shin-Etsu Silicone Co., Ltd.), was used instead of KBM1083 as the second surface-treating agent B (i.e., a polymerizable silane coupling agent) added to the ATO particles dispersion liquid in Example 1.

D50 and a degree of surface hydrophobicity of the ATO particles in the ATO particles dispersion liquid were measured in the same manner as in Example 1. D50 of the ATO particles was 79 nm and a degree of surface hydrophobicity thereof was 35%. The results of measurement are shown in Table 1 below.

Comparative Example 2

An organic photoreceptor was manufactured in the same manner as in Example 1, except that an ATO particles dispersion liquid was used, the ATO particles dispersion liquid including ATO particles surface-treated only with the first surface-treating agent A (i.e., a fluorine-based silane coupling agent), without adding the second surface-treating agent B (i.e., a polymerizable silane coupling agent) used in Example 1.

D50 and a degree of surface hydrophobicity of the ATO particles in the ATO particles dispersion liquid were measured in the same manner as in Example 1. D50 of the ATO particles was 74 nm and a degree of surface hydrophobicity thereof was 51%. The results of measurement are shown in Table 1 below.

Comparative Example 3

An organic photoreceptor was manufactured in the same manner as in Example 1, except that an ATO particles dispersion liquid was used, the ATO particles dispersion liquid including ATO particles surface-treated only with the second surface-treating agent B (i.e., a polymerizable silane coupling agent), without adding the first surface-treating agent A (i.e., a fluorine-based silane coupling agent) used in Example 1.

D50 and a degree of surface hydrophobicity of the ATO particles in the ATO particles dispersion liquid were measured in the same manner as in Example 1. D50 of the ATO particles was 133 nm and a degree of surface hydrophobicity thereof was 41%. The results of measurement are shown in Table 1 below.

Comparative Example 4

An organic photoreceptor was manufactured in the same manner as in Example 1, except that the dispersion was carried out for 70 hours.

D50 and a degree of surface hydrophobicity of the ATO particles in the ATO particles dispersion liquid were measured in the same manner as in Example 1. D50 of the ATO particles was 90 nm and a degree of surface hydrophobicity thereof was 32%. The results of measurement are shown in Table 1 below.

Comparative Example 5

An organic photoreceptor was manufactured in the same manner as in Example 1, except that 5 parts by mass of a different fluorine-based silane coupling agent, 1H,1H,2H,2H-heptadecafluorodecyl trimethoxysilane (product name T2917, available from Tokyo Chemical Industry Co., Ltd.), were used instead of T2918 as the first surface-treating agent A (i.e., a fluorine-based silane coupling agent) added to the ATO particles dispersion liquid.

D50 and a degree of surface hydrophobicity of the ATO particles in the ATO particles dispersion liquid were measured in the same manner as in Example 1. D50 of the ATO particles was 122 nm and a degree of surface hydrophobicity thereof was 14%. The results of measurement are shown in Table 1 below.

<Evaluation>

The performance of the organic photoreceptors manufactured in Examples 1 to 3 and Comparative Examples 1 to 5 were evaluated. The results thereof are shown in the following Table 1.

TABLE 1

| Sample | Average particle diameter (nm) | Degree of hydrophobicity (%) | After 250 kc rotation: Electrical properties 32° C./80% VL (V) | Image evaluation 32° C./80% | Blade turnover and squealing noise 32° C./80% | Surface of photoreceptor 10° C./20% |
|---|---|---|---|---|---|---|
| Example 1 | 65 | 46 | −58 | Good | No problem | No problem |
| Example 2 | 73 | 47 | −44 | Good | No problem | No problem |
| Example 3 | 95 | 43 | −47 | Good | No problem | No problem |
| Comparative Example 1 | 79 | 35 | −127 | Occurrence of image flow | No problem | No problem |
| Comparative Example 2 | 74 | 51 | −60 | Good | Occurrence of blade squealing noise | Occurrence of scratches |
| Comparative Example 3 | 133 | 41 | Evaluation was not possible because PTFE particles agglomerated at the surface of the photoreceptor | | | |
| Comparative Example 4 | 90 | 32 | −64 | Occurrence of image flow | No problem | No problem |
| Comparative Example 5 | 122 | 14 | −62 | Occurrence of image flow | No problem | No problem |

<Evaluation of Photoreceptor>

Each of the photoreceptors of Examples 1 to 3 and Comparative Examples 1 to 5 was mounted on an image forming apparatus (CLX-8650ND, available from Samsung Electronics, Co., Ltd.) to evaluate electrical properties (i.e., a potential after exposure=VL), an image quality, blade turnover and squealing noise, and a condition of a surface of the photoreceptor.

In Table 1, the term "kc rotation" refers to kilocycles of rotation of the photoreceptor, and thus 250 kc in Table 1 indicates 250,000 cycles of rotation of the photoreceptor.

<Electrical Properties: Measurement of Potential>

At a temperature of 32° C. and a relative humidity of 80%, the photoreceptor was mounted on an electrophotographic image forming apparatus (CLX-8650ND, available from Samsung Electronics, Co., Ltd.), and then an A4 size image, with individual colors of YMCBk at a coverage rate of 2.5%, was printed on 250,000 sheets of A4 neutral paper. After the 250,000 sheets were printed, VL was measured using a measuring probe. The results of the measurements are shown in Table 1.

The VL after the printing of 250,000 sheets was a surface potential measured after applying −600 V to the surface of the photoreceptor and exposing the surface to irradiation by a laser beam of 1 μJ/cm$^2$. The VL after the printing of 250,000 sheets was lower than the surface potential before exposure.

<Image Evaluation>

After printing 250,000 sheets in the same manner as for the measurement of potential, charts having 5% text were printed. Then, the image was evaluated for image flow with the naked eye. The results of measurements thereof are shown in Table 1.

In Table 1, the term "Good" indicates that image flow at the printing surface did not occur at all or that image flow occurred to an extent acceptable for practical use.

In Table 1, the term "occurrence of image flow" indicates that image flow at the printing surface occurred to an extent unacceptable for practical use.

<Blade Turnover and Squealing Noise>

At a temperature of 32° C. and a relative humidity of 80%, an A4 size image, with individual colors of YMCBk at a coverage rate of 2.5%, was printed on 250,000 sheets of A4 neutral paper by the same electrophotographic image forming apparatus used in the measurement of potential, to evaluate blade turnover and squealing noise. The results of measurements thereof are shown in Table 1.

In Table 1, the notation "no problem" means that blade turnover and squealing noise did not occur after all 250,000 sheets were printed out; or, that insignificant blade turnover and squealing noise occurred when the photoreceptor is started and stopped, to an acceptable extent in practical use of the photoreceptor.

In Table 1, the term "occurrence of blade squealing noise" indicates that blade turnover and squealing noise occurred continuously while printing.

<Surface of Photoreceptor>

After the evaluation of blade turnover and squealing noise, scratches on the surface of the photoreceptor were checked with the naked eye at a temperature of 10° C. and a relative humidity of 20%. The results of measurements thereof are shown in Table 1.

In Table 1, the term "no problem" indicates that scratches were not found on the surface of the photoreceptor or that insignificant scratches were found to an extent acceptable for practical use.

In Table 1, the term "occurrence of scratches" indicates that scratches occurred on the surface of the photoreceptor to an extent unacceptable for practical use.

<Evaluation of Examples 1 to 3>

VL of the photoreceptor after printing 250,000 sheets was −58 V in Example 1, was −44 V in Example 2, and was −47 V in Example 3. Upon comparing the photoreceptors of Examples 1 to 3 with that of Comparative Example 1 (−127 V), an increase in VL after printing 250,000 sheets was found to be suppressed. Thus, the photoreceptors of Examples 1 to 3 were found to have satisfactory electrical properties. In addition, regarding the photoreceptors of Examples 1 to 3, image flow was evaluated as "good," blade turnover and squealing noise were evaluated as "no problem", and scratches on the surface of the photoreceptor were evaluated as "no problem" after printing 250,000 sheets. As such, the photoreceptors of Examples 1 to 3 were each found to have satisfactory characteristics as a photoreceptor for a long time. Accordingly, the photoreceptors of Examples 1 to 3 were found to stably maintain satisfactory cleaning performance and image characteristics for a long time, and to have excellent durability and a long lifespan.

<Evaluation of Comparative Example 1>

Regarding the photoreceptor of Comparative Example 1, blade turnover and squealing noise were evaluated as "no problem", and scratches on the surface of the photoreceptor were evaluated as "no problem" after printing 250,000 sheets.

However, as described above, the photoreceptor of Comparative Example 1 was found to have VL of −127 V after printing 250,000 sheets. Upon comparing the photoreceptor of Comparative Example 1 with those of Examples 1 to 3, an increase in VL after printing 250,000 sheets was found not to be suppressed. Thus, the photoreceptor of Comparative Example 1 was found to have poor electrical properties. In addition, image flow after printing 250,000 sheets was evaluated as "occurrence of image flow". This may result from a low degree of surface hydrophobicity of the ATO particles of 35%, an increased amount of moisture in the protective layer, and an excessive amount of charge in the protective layer in the photoreceptor of Comparative Example 1. Accordingly, image flow occurred, which indicates deterioration of image characteristics.

<Evaluation of Comparative Example 2>

Regarding the photoreceptor of Comparative Example 2, image flow was evaluated as "Good", and VL was −60 V after printing 250,000 sheets.

However, regarding the photoreceptor of Comparative Example 2, blade turnover and squealing noise were evaluated as "occurrence of blade squealing noise", and scratches on the surface of the photoreceptor was evaluated as "occurrence of scratches" after printing 250,000 sheets. This may have resulted from a situation wherein, since the photoreceptor of Comparative Example 2 did not include the second surface-treating agent B (i.e., a polymerizable silane coupling agent) used in Example 1, the PTFE particles were not able to bind to the photocurable resin via the ATO particles, which caused the PTFE particles to be readily separated from the surface of the protective layer. Thus, the sliding properties (slidability) of the surface of the protective layer were not maintained in the photoreceptor of Comparative Example 2.

<Evaluation of Comparative Example 3>

It was not possible to measure VL of the photoreceptor of Comparative Example 3 after printing 250,000 sheets. Furthermore, since the PTFE particles agglomerated at the surface of the photoreceptor in the photoreceptor of Comparative Example 3, "evaluation was not possible" for image flow, blade turnover and squealing noise, and scratches on the surface of the photoreceptor. Since the first surface-treating agent A (i.e., a fluorine-based silane coupling agent) used in Example 1 was not included in the photoreceptor of Comparative Example 3, cohesiveness of the PTFE particles was not improved. Thus, the PTFE particles agglomerated at the surface of the photoreceptor of Comparative Example 3.

<Evaluation of Comparative Example 4>

Regarding the photoreceptor of Comparative Example 4, VL was −64 V, blade turnover and squealing noise were evaluated as "no problem", and scratches on the surface of the photoreceptor were evaluated as "no problem" after printing 250,000 sheets.

However, image flow was evaluated as "occurrence of image flow" in Comparative Example 4 after printing 250,000 sheets. Since the dispersion time of the dispersion liquid in Comparative Example 4 was shorter than that of Example 1, the amount of the first surface-treating agent A and the second surface-treating agent B bound to the surface of the ATO particles was not sufficient. Thus, the degree of surface hydrophobicity of the ATO particles was lowered to 32%, the amount of moisture in the protective layer increased, and the amount of charge in the protective layer became excessive, which consequently led to occurrence of image flow which indicates deterioration of image characteristics.

<Evaluation of Comparative Example 5>

Regarding the photoreceptor of Comparative Example 5, VL was −62 V, blade turnover and squealing noise were evaluated as "no problem", and scratches on the surface of the photoreceptor were evaluated as "no problem" after printing 250,000 sheets.

However, image flow was evaluated as "occurrence of image flow" in Comparative Example 5 after printing 250,000 sheets. Since the photoreceptor of Comparative Example 5 included the first surface-treating agent A (i.e., a fluorine-based silane coupling agent) having an alkyl fluoride group having 8 carbon atoms, the carbon chain was too long, which caused steric hindrance. This steric hindrance deteriorated the surface treatment, which led to a decrease in the degree of surface hydrophobicity of the ATO particles to 14%, an increase in the amount of moisture in the protective layer, and an excessive amount of charge in the protective layer. Accordingly, image flow occurred, which indicates deterioration of image characteristics.

Although each of the photoreceptors of Examples 1 to 3 included the negatively chargeable multi-layered photosensitive layer as a photosensitive layer, when the aforementioned protective layer is disposed on a photosensitive layer, a photoreceptor including a positively chargeable single-layered photosensitive layer as a photosensitive layer may also be used to produce the same effect.

Fluororesin particles, a surface of which may support some of the metal oxide particles including a first surface-treating agent and a second surface-treating agent, may be polar due to the metal oxide particles supported on the surface thereof. Accordingly, agglomeration of the fluororesin particles in a protective layer may be prevented, thereby improving dispersibility of the fluororesin particles and enabling homogeneous dispersion of the fluororesin particles along with the metal oxide particles in the protective layer. Further, since the fluororesin particles are fixed to a binder resin via the metal oxide particles having the first surface-treating agent and the second surface-treating agent and supported on the surface of the fluororesin particles, the fluororesin particles may be supported in the protective layer and may not readily be separated from a surface of the protective layer. Due to the fluororesin particles not readily separating from the surface of the protective layer, the protective layer may have satisfactory slidability and maintain cleaning performance thereof.

In addition, when a degree of surface hydrophobicity of the metal oxide particles having the first surface-treating agent and the second surface-treating agent is 40% or greater, adsorption of extra moisture onto the protective layer may be prevented. Accordingly, it is possible to provide chargeability to such an extent that no image flow of the protective layer occurs, thus imparting appropriate conductivity to the protective layer. In a photoreceptor having a protective layer in which image flow is suppressed, an increase in a residual potential of a surface of the photoreceptor may be suppressed without deteriorating a charge transporting ability of the protective layer. By suppressing the increase of the residual potential, an electrostatic latent image having a sharp outline may be formed on the surface of the photoreceptor. Thus, satisfactory image characteristics may be stably maintained for a long time.

Therefore, according to one or more examples, an electrophotographic photoreceptor is provided that may maintain satisfactory cleaning performance and image characteristics stably over a long time and have excellent durability and a long lifespan, and an electrophotographic image forming apparatus is provided which may include the electrophotographic photoreceptor.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An electrophotographic photoreceptor comprising:

a conductive support;

a photosensitive layer on the conductive support; and a protective layer on the photosensitive layer, wherein the protective layer comprises a binder resin, metal oxide particles, and fluororesin particles, wherein the metal oxide particles comprise, on a surface thereof, a first surface-treating agent comprising fluorine atoms, and a second surface-treating agent comprising a polymerizable reactive group and a hydrophobic group, wherein at least some of the metal oxide particles are supported on a surface of the fluororesin particles by being adsorbed onto the surface of the fluororesin particles via the fluorine atoms of the first surface-treating agent, and wherein the fluororesin particles are fixed to the binder resin via the at least some of the metal oxide particles supported on the surface of the fluororesin particles.

2. The electrophotographic photoreceptor of claim 1, wherein a degree of a surface hydrophobicity of the metal oxide particles is about 40% or greater.

3. The electrophotographic photoreceptor of claim 1, wherein a compounding ratio of the first surface-treating agent to the metal oxide particles is about 10% by mass to about 15% by mass.

4. The electrophotographic photoreceptor of claim 1, wherein the at least some of the metal oxide particles supported on the surface of the fluororesin particles are bound to the binder resin via the polymerizable reactive group of the second surface-treating agent.

5. The electrophotographic photoreceptor of claim 1, wherein the first surface-treating agent comprises an alkyl fluoride group having 4 to 7 carbon atoms.

6. The electrophotographic photoreceptor of claim 1, wherein the polymerizable reactive group of the second surface-treating agent comprises at least one selected from the group consisting of an acryloyl group, a methacryloyl group, and a vinyl group.

7. The electrophotographic photoreceptor of claim 1, wherein the hydrophobic group of the second surface-treating agent comprises at least one selected from the group consisting of an alkyl group comprising 6 or more carbon atoms and an alkylene group comprising 6 or more carbon atoms.

8. The electrophotographic photoreceptor of claim 1, wherein the metal oxide particles comprise at least one selected from the group consisting of antimony-doped tin oxide, titanium oxide, and zinc oxide.

9. The electrophotographic photoreceptor of claim 1, wherein the fluororesin particles comprise polytetrafluoroethylene (PTFE).

10. The electrophotographic photoreceptor of claim 1, wherein the binder resin comprises a photocurable resin comprising a photofunctional group; and the photofunctional group is bound to the polymerizable reactive group of the second surface-treating agent.

11. An image forming apparatus comprising:

an electrophotographic photoreceptor according to claim 1;

a charging unit configured to charge the electrophotographic photoreceptor;

a light exposure unit configured to expose the charged electrophotographic photoreceptor to light to form an electrostatic latent image on the charged electrophotographic photoreceptor;

a developing unit configured to develop the electrostatic latent image using toner to form a toner image on the electrophotographic photoreceptor;

a transferring unit configured to transfer the toner image to a transfer medium; and a cleaning unit configured to remove any toner remaining on the electrophotographic photoreceptor after the transferring of the toner image to the transfer medium.

12. The electrophotographic photoreceptor of claim 1, wherein the hydrophobic group of the second surface-treating agent comprises at least one selected from the group consisting of an alkyl group comprising 6 or more carbon atoms and 12 or less carbon atoms and an alkylene group comprising 6 or more carbon atoms and 12 or less carbon atoms.

13. The electrophotographic photoreceptor of claim 1, wherein a compounding ratio of the second surface-treating agent to the metal oxide particles is about 3% by mass to about 10% by mass.

14. An electrophotographic photoreceptor comprising:

a conductive support;

a photosensitive layer on the conductive support; and a protective layer on the photosensitive layer, wherein the protective layer comprises a binder resin, metal oxide particles, and fluororesin particles, wherein the metal oxide particles comprise, on a surface thereof, a first surface-treating agent comprising fluorine atoms, and a second surface-treating agent comprising a polymerizable reactive group and a hydrophobic group, wherein at least some of the metal oxide particles are bound to the binder resin via the polymerizable reactive group of the second surface-treating agent, and wherein the fluororesin particles are fixed to the binder resin via the at least some of the metal oxide particles supported on the surface of the fluororesin particles by being adsorbed onto the surface of the fluororesin particles.

15. The electrophotographic photoreceptor of claim 14, wherein a degree of a surface hydrophobicity of the metal oxide particles is about 40% or greater.

16. The electrophotographic photoreceptor of claim 14, wherein the first surface-treating agent comprises an alkyl fluoride group having 4 to 7 carbon atoms.

17. The electrophotographic photoreceptor of claim 14, wherein the polymerizable reactive group of the second surface-treating agent comprises at least one selected from the group consisting of an acryloyl group, a methacryloyl group, and a vinyl group.

18. The electrophotographic photoreceptor of claim 14, wherein the hydrophobic group of the second surface-treating agent comprises at least one selected from the group consisting of an alkyl group comprising 6 or more carbon atoms and an alkylene group comprising 6 or more carbon atoms.

19. The electrophotographic photoreceptor of claim 14, wherein the metal oxide particles comprise at least one selected from the group consisting of antimony-doped tin oxide, titanium oxide, and zinc oxide.

20. The electrophotographic photoreceptor of claim 14, wherein the fluororesin particles comprise polytetrafluoroethylene (PTFE).

21. The electrophotographic photoreceptor of claim 14, wherein the binder resin comprises a photocurable resin comprising a photofunctional group; and the photofunctional group is bound to the polymerizable reactive group of the second surface-treating agent.

22. An image forming apparatus comprising:

an electrophotographic photoreceptor according to claim 14;

a charging unit configured to charge the electrophotographic photoreceptor;

a light exposure unit configured to expose the charged electrophotographic photoreceptor to light to form an electrostatic latent image on the charged electrophotographic photoreceptor;

a developing unit configured to develop the electrostatic latent image using toner to form a toner image on the electrophotographic photoreceptor;

a transferring unit configured to transfer the toner image to a transfer medium; and a cleaning unit configured to remove any toner remaining on the electrophotographic photoreceptor after the transferring of the toner image to the transfer medium.

23. The electrophotographic photoreceptor of claim 14, wherein a compounding ratio of the first surface-treating agent to the metal oxide particles is about 10% by mass to about 15% by mass.

* * * * *